United States Patent [19]

Plyler et al.

[11] 4,390,231

[45] Jun. 28, 1983

[54] BLADE TERMINAL WITH PROTECTED LATCH TANGS

[75] Inventors: Robert G. Plyler, Vienna; Lyle B. Suverison, Fowler, both of Ohio

[73] Assignee: General Motors Corporation, Detroit, Mich.

[21] Appl. No.: 960,490

[22] Filed: Nov. 13, 1978

Related U.S. Application Data

[63] Continuation-in-part of Ser. No. 919,765, Jun. 28, 1978.

[51] Int. Cl.[3] ..... H01R 13/432

[52] U.S. Cl. ..... 339/217 S

[58] Field of Search ..... 339/217 R, 217 S, 217 J

[56] References Cited

U.S. PATENT DOCUMENTS

| | | | |
|---|---|---|---|
| 2,130,424 | 9/1938 | Grant | 173/361 |
| 2,974,302 | 3/1961 | Ellis | 339/278 |
| 2,989,723 | 6/1961 | Hopkins et al. | 339/213 |
| 3,155,449 | 11/1964 | Henschen | 339/217 S |
| 3,461,258 | 8/1969 | Shlesinger | 200/153 |
| 3,796,987 | 3/1974 | Kinkaid | 339/217 S |
| 4,053,197 | 10/1977 | Teagno | 339/217 S. |
| 4,174,880 | 11/1979 | Hawkins et al. | 339/217 S |

OTHER PUBLICATIONS

Dwg. No. 12004554, Packard Electric Division, G.M.C., 7-12-76.

Dwg. No. 8917903, Packard Electric Division, G.M.C., 4-18-75.

*Primary Examiner*—Eugene F. Desmond

*Attorney, Agent, or Firm*—F. J. Fodale

[57] ABSTRACT

A blade terminal has a forward contact portion comprising a pair of flat longitudinal juxtaposed blades and an enlarged channel shaped median portion of reduced width. A pair of longitudinal inclined latch tangs attached to the respective rearward edges of the blades are positioned adjacent the channel shaped median portion for protection. The lateral extensions of the side walls of the channel shaped median portion offer further protection and may serve as forward stops and/or secondary locks in conjunction with a lock bar. A modified terminal has the leading edges set at an angle to reduce mating forces.

4 Claims, 7 Drawing Figures

BLADE TERMINAL WITH PROTECTED LATCH TANGS

This application is a continuation-in-part of pending U.S. patent application Ser. No. 919,765 filed June 28, 1978.

This invention relates generally to electrical connectors and more particularly to electrical blade terminals having a resilient latch tang or tangs and rigid stop portions for locking the terminal in a connector body cavity.

Such a terminal is generally shown in the U.S. Pat. No. 3,555,496 granted to W. Pearce, Jr. et al Jan. 21, 1971 which discloses a blade terminal 10 having a resilient latch tang 34 and rigid stop surfaces 35 and 36. The latch tang 34 projects outwardly of the multilayered portion behind the blade 22 and the flanges 26 and 28 crimped on the electrical wire 40. Then outwardly projecting latch tang 34 is exposed to damage during handling and presents a possible tangling problem in assembling wiring harnesses having several electrical wires with such terminals attached to their ends. Further the terminal does not have any convenient structure for a secondary lock.

Broadly the object of this invention is to provide an electrical blade terminal having a resilient latch tang in a protected position to avoid possible damage during handling and tangling problems during wiring harness assembly.

Another object of the invention is to provide an electrical blade terminal having a balanced pair of resilient latch tangs in protected positions which avoid possible damage and tangling.

Another object of the invention is to provide an electrical blade terminal having a protected resilient latch tang or tangs in which protective structure of the terminal also provides convenient structure for a rigid stop and/or a secondary lock.

Other objects and features of the invention will become apparent to those skilled in the art as the disclosure is made in the following detailed description of a preferred embodiment of the invention as illustrated in the accompanying sheets of drawing in which.

Figure 1:
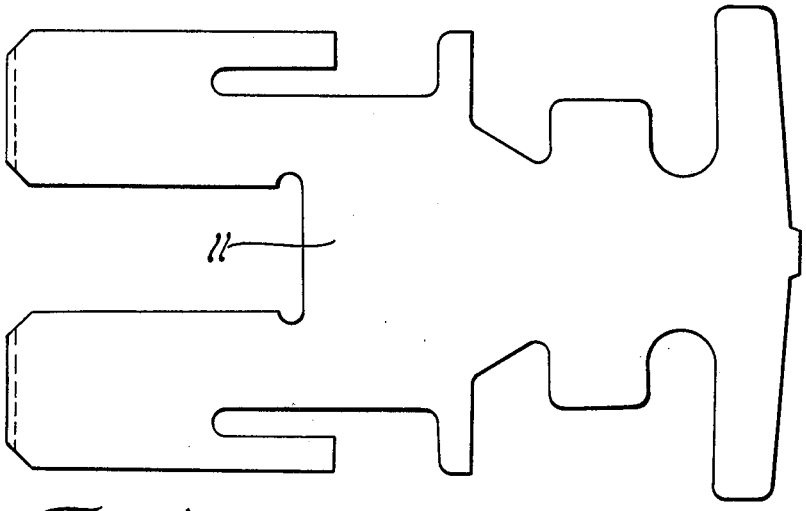
FIG. 1 is a plan view of a stamped blank for fabricating an electrical blade terminal in accordance with this invention.
Figure 2:
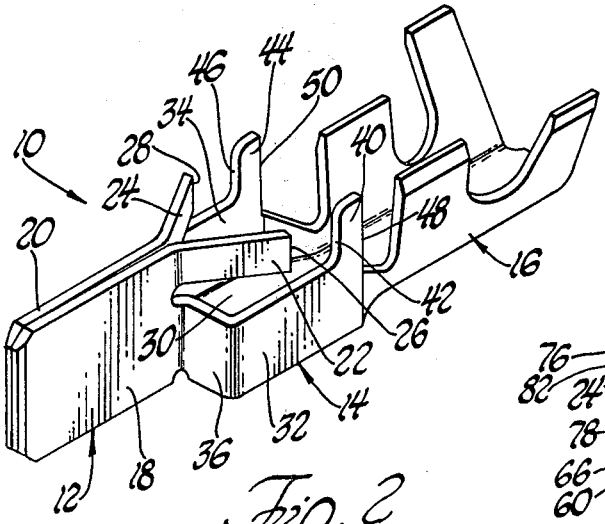
FIG. 2 is a perspective view of an electrical blade terminal in accordance with this invention.
Figure 4:
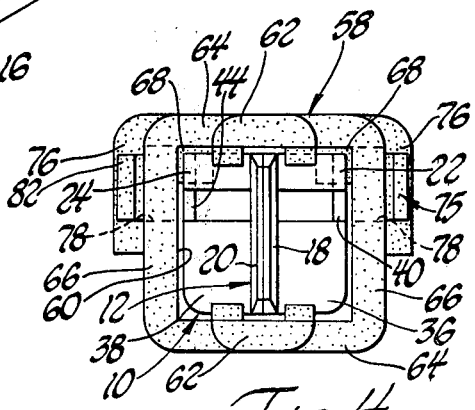
FIG. 4 is a front view of the terminal and connector body taken substantially along the line 4—4 of FIG. 3 looking in the direction of the arrows.
Figure 3:
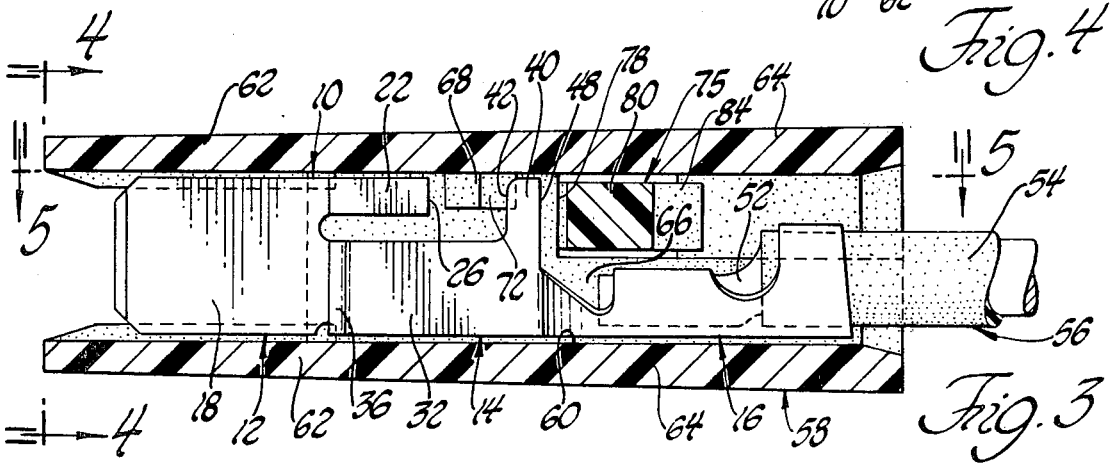
FIG. 3 is a longitudinal view, partially sectioned, showing the terminal of FIG. 2 locked in a terminal cavity of a connector body.

Referring now to the drawing and more particularly to FIG. 2, there is disclosed an electrical blade terminal 10 of unitary sheet metal construction made from the blank 11 illustrated in FIG. 1. The blade terminal 10 has a forward contact portion 12, a channel shaped median portion 14 and a rearward attachment portion 16. The forward contact portion 12 comprises a pair of flat longitudinal blades 18 and 20 juxtaposed each other and providing a double layered blade. A pair of resilient inclined latch tangs 22 and 24 are attached at the respective rear edges of the blades 18 and 20 from which the inclined latch tangs 22 and 24 extend rearwardly and outwardly of the blades 18 and 20 in divergent manner. The inclined latch tangs 22 and 24 are in a protected position adjacent the median portion 14 and are sized so that the trailing ends 26 and 28 do not project outwardly of the side walls 32 and 34.

The channel shaped median portion 14 comprises a web 30 and parallel side walls 32 and 34 which are parallel to the blades 18 and 20 but of reduced width in comparison thereto to provide space for the inclined latch tangs 22 and 24. The side walls 32 and 34 are connected to the rear edges of the blades 18 and 20 by transition portions 36 and 38 of like width.

Figure 5:
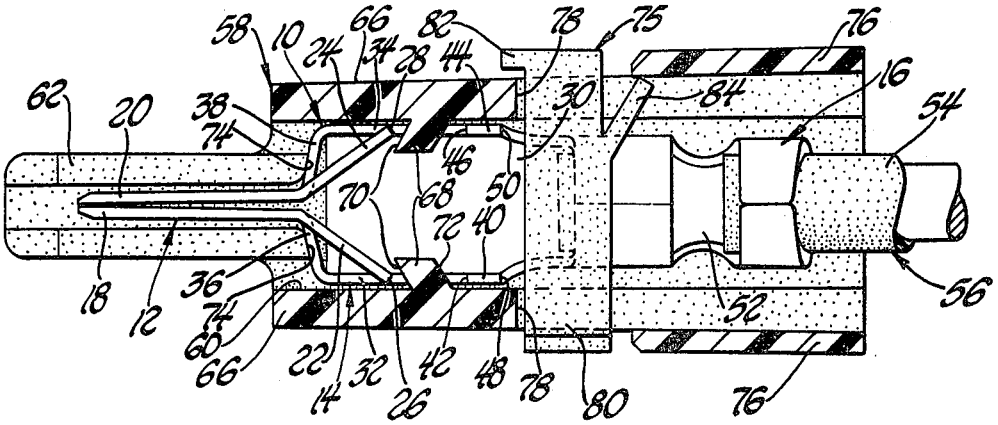
FIG. 5 is a section taken substantially along the line 5—5 of FIG. 3 looking in the direction of the arrows.
Figure 6:
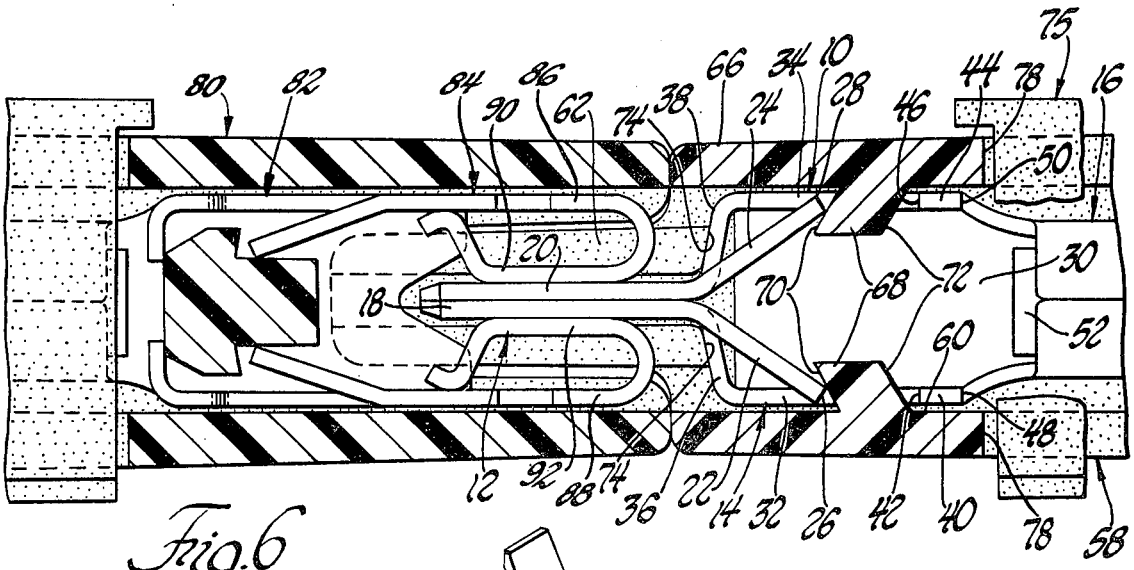
FIG. 6 is a view similar to FIG. 5 showing the terminal and connector body of FIG. 5 attached to a mating terminal and connector body.

As clearly shown in FIGS. 5 and 6, the leading edge of the web 30 is behind the transition portions 36 and 38. Thus the transition portions 36 and 38 are separate and connected to the respective blades 18 and 20 which are also separate. The transition portions 36 and 38 are nearly upright and connect to the respective blades 18 and 20 at the same longitudinal location where the inclined latch tangs 22 and 24 are attached. Consequently each inclined latch tang is entirely within the outline of the adjacent side wall and connecting transition portion.

Each of the side walls 32 and 34 has a coplanar lateral extension associated with it which provides further projective structure for the inclined latch tangs 22 and 24 and also provides convenient structure for forward stops and/or secondary locks.

More particularly, the side wall 32 has a coplanar lateral extension 40 which is located behind the latch tang 22 and preferably spaced rearwardly thereof a sufficient distance so that the front surface 42 is a convenient alternate stop as will hereinafter more fully appear.

The side wall 34 likewise has a coplanar lateral extension 44 located behind the tang 24 a sufficient distance to permit its front surface 46 to function as a forward stop. The coplanar rear surfaces 48 and 50 of the extensions 40 and 44 also provide cooperating lock surfaces for a secondary terminal lock as will hereinafter more fully appear.

The attachment portion 16 comprises core and insulation crimp flanges which are crimped to the core 52 and insulation 54 respectively of an electrical wire 56 in conventional manner. The attachment portion 16 is attached to the web 30 and is in an offset position with respect to the contact portion 12 to unblock the lateral extensions 40 and 44.

The electrical blade terminal 10 attached to the electrical wire 56 is illustrated in conjunction with a single cavity connector body 58 in FIGS. 3, 4, 5 and 6. The connector body 58 is generally rectangular in shape. It has a single rectangular open ended terminal cavity 60 and slotted projections 62 extending from one pair of side walls 64 at its mating end. The other pair of side walls 66 each have a corner block 68 at one of the side walls 64 which projects into a median portion of the cavity 60 a short distance. Each corner block 68 has a forward latch shoulder 70 and a rear ramp 72.

During terminal insertion, the resilient inclined latch tangs 22 and 24 ride up the ramps 72 and snap into position ahead of the latch shoulders 70 to latch the terminal 10 in the cavity 60. Over insertion is prevented by the transitions 36 and 38 engaging abutments 74. Alternatively forward stops may be provided by the front surfaces 42 and 46 of the lateral extensions 40 and 44 engaging the ramps 72.

In some instances, it is desirable to provide a positive lock against terminal withdrawal as a precautionary measure. In such instances the coplanar rear surfaces 48 and 50 may be utilized in cooperation with a common lock bar 75 which is assembled to the connector body 58 after the terminal 10 is latched in the cavity 60.

To this end, the connector body 58 has an offset enlargement 76 at the wire end which facilitates molding cross apertures 78 located behind the lateral extensions 40 and 44 when the terminal 10 is properly positioned in the cavity 60. These apertures 78 receive a rectangular shank 80 of the lock bar 75 which is retained on the connector body 58 by an external head 82 and a resilient latch arm 84.

FIG. 6 shows the connector body 58 mated to a connector body 80 which carries a female terminal 82 which mates with the blade terminal 10.

The female terminal 82 is of the general type disclosed in pending U.S. patent application Ser. No. 919,781 filed June 28, 1978 entitled "Electrical Terminal with Anti-Tangle Tangs" and U.S. Pat. No. 3,267,410 issued Aug. 16, 1966 to Baer et al. These female terminals are characterized by a forward contact portion 84 comprising two flat U-shaped longitudinal arms 86 and 88 which are spaced apart when the double layered blade 12 is inserted between them. The arms in their free state have inner legs 90 and 92 which lie very close to each other and in some instances even abut.

Figure 7:
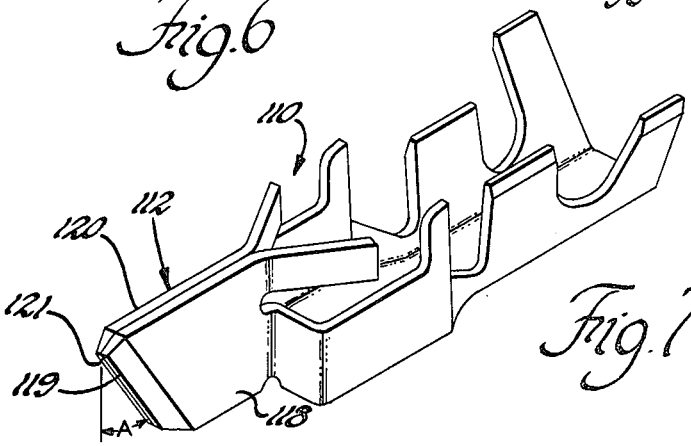
FIG. 7 is a perspective view of a modified terminal in accordance with this invention.

Mating a double layered blade with a female terminal of this type which was originally designed for a single blade terminal may require undesirably high mating forces. In such instances, the modified terminal 110 shown in FIG. 7 may be used. This terminal has a forward contact portion 112 comprising a juxtaposed pair of flat longitudinal blades 118 and 120 having tips or leading edges 119 and 121 which are set at an angle A or bias rather than square to the blades as in FIG. 2. The terminal 110 is otherwise the same as the terminal 10.

When the double layered blade 112 is inserted into the female terminal, only the end portions of the legs 90 and 92 are initially spread apart. This is followed by a gradual spreading apart of the legs 90 and 92 along their entire width. This requires a lower mating force than that required by the design shown in FIG. 2. An angle of about 30° appears adequate for most purposes.

We wish it to be understood that we do not desire to be limited to the exact details of construction shown and described, for obvious modifications will occur to a person skilled in the art.

What is claimed is:

1. A terminal having protected latch tang means for latching the terminal in a connector body comprising:

a forward contact portion comprising a pair of separate longitudinal blades, an enlarged channel shaped median portion having a web and side walls of reduced width connected to respective ones of the separate longitudinal blades by separate transition portions, a pair of longitudinal inclined latch tangs attached to the respective rearward edges of the longitudinal blades and diverging away from each other in the rearward direction, said pair of inclined latch tangs being adjacent the channel shaped median portion at a side opposite the web, each of said inclined latch tangs being entirely within the outline of an adjacent side wall and connecting transition portion, a lateral extension on each side wall spaced rearwardly of the latch tangs, each lateral extension having a portion behind and in longitudinal alignment with one of the latch tangs, and an attachment portion attached to the web in an offset position with respect to the forward contact portion.

2. A terminal having protected latch tang means for latching the terminal in a connector body comprising:

a forward contact portion comprising a pair of separate flat longitudinal blades juxtaposed each other to form a double layered blade, an enlarged channel shaped median portion having a web and parallel side walls of reduced width connected to respective ones of the separate longitudinal blades by separate converging transition portions of the same width, a pair of longitudinal inclined latch tangs attached to the respective rearward edges of the longitudinal blades and diverging away from each other in the rearward direction, said pair of inclined latch tangs being adjacent the channel shaped median portion at a side opposite the web, each of said inclined latch tangs being entirely within the outline of an adjacent side wall and connecting transition portion, a coplanar lateral extension on each side wall spaced rearwardly of the latch tangs, each lateral extension having a portion behind and in longitudinal alignment with one of the latch tangs, and an attachment portion attached to the web and disposed in an offset position with respect to the longitudinal blades to unblock the lateral extensions.

3. The terminal as defined in claim 2 wherein the blades have leading edges set at an angle of about 30° with respect to a longitudinal edge of the blades.

4. A terminal having protected latch tang means for latching the terminal in a connector body comprising:

a forward contact portion comprising a pair of separate longitudinal blades forming a double layered blade having an angled leading edge for reducing mating force requirements, an enlarged channel shaped median portion having a web and side walls of reduced width connected to respective ones of the separate longitudinal blades by separate transition portions, a pair of longitudinal inclined latch tangs attached to the respective rearward edges of the longitudinal blades and diverging away from each other in the rearward direction, said pair of inclined latch tangs being adjacent the channel shaped median portion at a side opposite the web, each of said inclined latch tangs being entirely within the outline of an adjacent side wall and connecting transition portion, and a lateral extension on each side wall spaced rearwardly of the latch tang, each lateral extension having a portion behind and in longitudinal alignment with one of the latch tangs.

* * * * *